US008227970B2

(12) United States Patent
Freudenberger

(10) Patent No.: US 8,227,970 B2
(45) Date of Patent: Jul. 24, 2012

(54) THERMIONIC EMISSION DEVICE

(75) Inventor: Joerg Freudenberger, Kalchreuth (DE)

(73) Assignee: Siemens Aktiengesellschaft, Munich (DE)

( * ) Notice: Subject to any disclaimer, the term of this patent is extended or adjusted under 35 U.S.C. 154(b) by 276 days.

(21) Appl. No.: 12/691,379

(22) Filed: Jan. 21, 2010

(65) Prior Publication Data

US 2010/0181942 A1 Jul. 22, 2010

(30) Foreign Application Priority Data

Jan. 21, 2009 (DE) ..... 10 2009 005 454

(51) Int. Cl.
*H01J 9/02* (2006.01)

(52) U.S. Cl. ..... 313/310

(58) Field of Classification Search ..... 315/326
See application file for complete search history.

(56) References Cited

U.S. PATENT DOCUMENTS

| | | | | |
|---|---|---|---|---|
| 3,914,639 | A * | 10/1975 | Barraco et al. | 313/271 |
| 6,115,453 | A * | 9/2000 | Hell et al. | 378/136 |
| 6,259,193 | B1 * | 7/2001 | Lipkin et al. | 313/341 |
| 6,426,587 | B1 * | 7/2002 | Hell et al. | 313/341 |
| 6,624,555 | B2 * | 9/2003 | Hell et al. | 313/329 |
| 6,646,366 | B2 | 11/2003 | Hell et al. | |
| 7,693,265 | B2 * | 4/2010 | Hauttmann et al. | 378/136 |
| 8,000,449 | B2 * | 8/2011 | Hauttmann et al. | 378/136 |
| 2008/0203885 | A1 * | 8/2008 | Ono et al. | 313/310 |
| 2010/0067663 | A1 * | 3/2010 | Freudenberger et al. | 378/136 |
| 2010/0176708 | A1 * | 7/2010 | Hauttmann | 313/310 |
| 2011/0280377 | A1 * | 11/2011 | Freudenberger et al. | 378/136 |

FOREIGN PATENT DOCUMENTS

| | | |
|---|---|---|
| DE | 100 04 986 | 8/2001 |
| DE | 102 11 947 | 10/2003 |
| WO | WO 2008/047269 | 4/2008 |

* cited by examiner

*Primary Examiner* — Toan Ton
*Assistant Examiner* — Britt D Hanley
(74) *Attorney, Agent, or Firm* — Schiff Hardin LLP

(57) ABSTRACT

A thermionic emission device, in particular for use in an x-ray tube, has an indirectly heated primary emitter that is fashioned as a flat emitter with an unstructured primary emission surface, and a heating emitter that is fashioned as a flat emitter with a structured heat emission surface. The primary emitter and the heating emitter each has at least two terminal lugs, and the primary emission surface and the heat emission surface are aligned essentially parallel to one another. The emission device provides an optimally high quality of the focal spot with a simple design and, given high thermal load, an unwanted widening or defocusing of the electron beam is avoided by the terminal lugs of the primary emitter being aligned essentially perpendicular to the primary emission surface and not protruding beyond the primary emission surface in the lateral direction.

10 Claims, 3 Drawing Sheets

THERMIONIC EMISSION DEVICE

BACKGROUND OF THE INVENTION

1. Field of the Invention

The present invention concerns a thermionic emission device (in particular for use in an x-ray tube) with an indirectly heated primary emitter that is fashioned as a flat emitter with an unstructured primary emission surface, and with a heating emitter that is fashioned as a flat emitter with a structured heat emission surface, wherein the primary emitter and the heating emitter respectively have at least two terminal lugs, and wherein the primary emission surface and the heat emission surface are aligned essentially parallel to one another.

2. Description of the Prior Art

A thermionic emission device of the above type, that is used as a cathode in an x-ray tube, is known from WO 2008/047269 A2. In this emission device an indirectly heated, unstructured, flat emission surface, having at least two fixing elements that lie in the plane of the emission surface and through which an electrical current can be conducted, is structurally fixed in a unit surrounding it. This emission surface is heated by electron bombardment from a directly heated flat emitter with a structured emission surface through which a heating current is directed.

An unstructured emission surface means a flat, essentially homogenous emission surface without slits or similar interruptions. An emission surface that is interrupted by slits or has a serpentine conductor trace is designated as structured.

The size of the focal spot at which the electrons accelerated from the cathode in the direction of the anode strike the anode is of prominent importance for the quality of the x-ray radiation generated by an x-ray tube. The size of the focal spot can be disadvantageously affected by the design of the electron-emitted components.

For example, if a directly heated flat emitter for electron emission is used to generate x-ray radiation, its emission surface is generally structured and has slits or similar interruptions. A serpentine structure of the conductor trace is generally necessary so that the heating current flows through the entire emission surface and heats uniformly. The electrical field lines then extend into the interstices in the emission surface that are produced by the slits and thereby have a component tangential to the emission surface. Since the electrons essentially follow the field lines on their path to the anode, the optical aberration of the electron source is intensified and the focal spot is enlarged in an unwanted manner. For this reason the aforementioned design with an indirectly heated, unstructured emitter is generally preferred.

The emission device known from WO 2008/047269 A2 exhibits the disadvantage that a thermal expansion of the terminal lugs (also designated as emitter legs) can lead to a deflection of the primary emission surface, and therefore to an unwanted defocusing of the electron beam.

SUMMARY OF THE INVENTION

An object of the invention is to provide an emission device of the aforementioned type in which an optimally high quality of the focal spot is achieved with a structure that has a simple design, and in which an unwanted widening or defocusing of the electron beam is avoided even at high thermal load.

This object is achieved according to the invention by an emission device wherein the terminal lugs of the primary emitter are aligned essentially perpendicular to the primary emission surface and do not protrude beyond the primary emission surface in the lateral direction.

The invention proceeds from the insight that the emission surface can deflect slightly given thermal expansion in the design that has heretofore been typical (in which the terminal lugs or conductor legs supplying the emitter with current lie essentially in the plane of the emission surface and laterally fix the emission surface), which under the circumstances leads to an unwanted defocusing of the electron beam. Moreover, in such a conventional design a certain portion of thermally excited electrons can also escape from the terminal lugs in the operating state and be accelerated in the direction of the anode, so an unwanted enlargement of the focal spot results. Such problems are reliably avoided with the arrangement of the heating emitter, primary emitter and terminal lugs provided in accordance with the invention.

Moreover, the present invention takes into account the circumstance that in many cases an optimization of a thermionic emission device in x-ray tubes (in particular in rotary piston radiators) with regard to installation space is desirable. In a number of x-ray tubes, the emitters are surrounded by a focus head that is not flat on the side facing toward the anode. In such configurations it is disadvantageous when the elements that serve to structurally fix the emitters and for current feed laterally project beyond the primary emission surface. Since the terminal lugs of the primary emitter in the inventive arrangement do not protrude beyond its emission surface, the emission unit with the primary emission surface can be enclosed in a structurally close manner by a surrounding focus head or a diaphragm or the like.

Due to the use of an unstructured emission surface, the electron paths for the primary emitter run close to the emission location of the electrons, essentially without tangential components with regard to the emission surface. By contrast, in the use of a heating emitter that indirectly heats the primary emitter, inhomogeneities (that arise in the emission surface, for example due to slits) are not of such great consequence. Therefore such a structured emitter is very well suited as a heating emitter.

The essentially perpendicular alignment of the terminal lugs relative to the respective emission surfaces ensures that electrons emitted by the terminal lugs do not reach the anode and thus do not undesirably enlarge the focal spot. The terminal lugs can compensate for the thermal expansion of the unstructured emission surface via elastic expansion without this being deformed or deflected. The thermal expansion of the terminal lugs themselves is largely unproblemmatical in this arrangement. Since it pertains to all terminal lugs in the same manner and essentially to the same degree, an acceptably slight longitudinal displacement of the entire emission surface occurs in every case but no deflection or inclination.

The dimensions of the heating emitter are advantageously selected so that the heat emission surface does not project beyond the primary emission surface in the lateral direction.

The terminal lugs of the heating emitter advantageously do not project beyond the heat emission surface in the lateral direction. A minimal space requirement in a lateral regard is achieved when both the heat emission surface and the terminal lugs of the heating emitter do not project laterally beyond the primary emission surface.

The heat emission surface is advantageously fashioned as a wandering conductor trace. In the operating state of the heating emitter, the conductor trace defines the path of the heating current through the emission surface.

In an embodiment, each of the two emitters has exactly two terminal lugs. These are advantageously connected opposite one another with the outer edge of the respective emission surface or molded on the emission surface.

In the operating state of the emission unit, a heating current that leads to a thermionic emission of electrons is directed through the heat emission surface. The electrons released from the heating emitter strike the rear side of the primary emitter that is facing away from the anode and heat this upon impact so that its front side emits electrons that are accelerated toward the anode. A current that resupplies the electrons discharged by emission is typically likewise directed through the primary emission surface.

In another embodiment, each emitter—primary emitter and heating emitter—has exactly two terminal lugs, and the two emitters are arranged such that the in total four terminal lugs essentially stand in a row. This means that the two terminal lugs of the heating emitter essentially stand spatially between the terminal lugs of the primary emitter. This arrangement allows an improvement of the focal spot quality in that the heating current and the current through the primary emission surface are directed in opposite directions and with essentially identical amperage. The two magnetic fields generated by the current largely compensate one another in this manner. It is thus avoided that the magnetic field generated by the heating current affects the electron paths in an unwanted manner.

The emission surfaces of both emitters are advantageously fashioned as circles. An optimal volume utilization in an extremely asymmetrical design is achieved in this way.

In another embodiment, the primary emission surface is surrounded with segments that preferably respectively have the shape of a circular ring segment, wherein every segment is connected with the (advantageously circular) primary emission surface via (advantageously) one or more narrow webs. The segments provided to decrease temperature at the edges of the emission surface should thereby have no direct connection with one another. It has proven to be advantageous to select the webs such that essentially no current flows from the primary emission surface into the segments, and that furthermore essentially no heat transport occurs from the primary emission surface via the webs into the segments. As a result, the segments do not emit electrons, which would lead to an enlargement of the focal spot. The equipotential areas of the electrical potential at the edge of the emission surface are deskewed by the webs, so bending of the electron paths of the electrons emitted from the edge area is prevented. The ring made of segments also shields electrons that are thermionically released from the side of the emitter facing away from the anode.

The primary emitter is advantageously surrounded on the side opposite the heating emitter by a diaphragm. The use of a diaphragm allows the shielding of edge regions of the primary emission surface from which no electrons should be accelerated towards the anode. The diaphragm aperture is advantageously adjustable or controllable, so the size of the focal spot can also be actively influenced.

According to another embodiment, the positive pole of a voltage source is connected with the primary emission surface and the negative pole with the heat emission surface. The connection ensues via the respective terminal lugs of the two emitters, for example. The applied voltage should advantageously lie between 0 and 300 volts. The electrons that are released from the emission surface in its operating state are accelerated in this way in the direction of the primary emission surface where their kinetic energy is transduced into heat energy, and the primary emission surface is thus heated.

At least one thermionic emission device of the aforementioned type is advantageously used in an x-ray tube.

Advantages achieved with the invention include an optimized installation space utilization of the emission device combined with a high focal spot quality. No space requirement for a structural fixing and/or the current feed exists in the lateral direction due to the alignment of the terminal lugs of the primary emitter that is chosen essentially perpendicular to the emission surface (which terminal lugs do not project beyond the primary emission surface). Rather, the installation space that is obtained in this way can be used otherwise. The arrangement of the two emitters relative to one another —in which the primary emitter surface and the heat emitter surface are aligned essentially parallel to one another—and the use of an unstructured flat emitter to generate the electron beam ensure that essentially only electrons that are emitted from the primary emission surface reach the anode. By use of a diaphragm, the region of the primary emission surface from which emitted electrons should arrive at the anode can be limited as needed.

DESCRIPTION OF THE PREFERRED EMBODIMENTS

Figure 1:
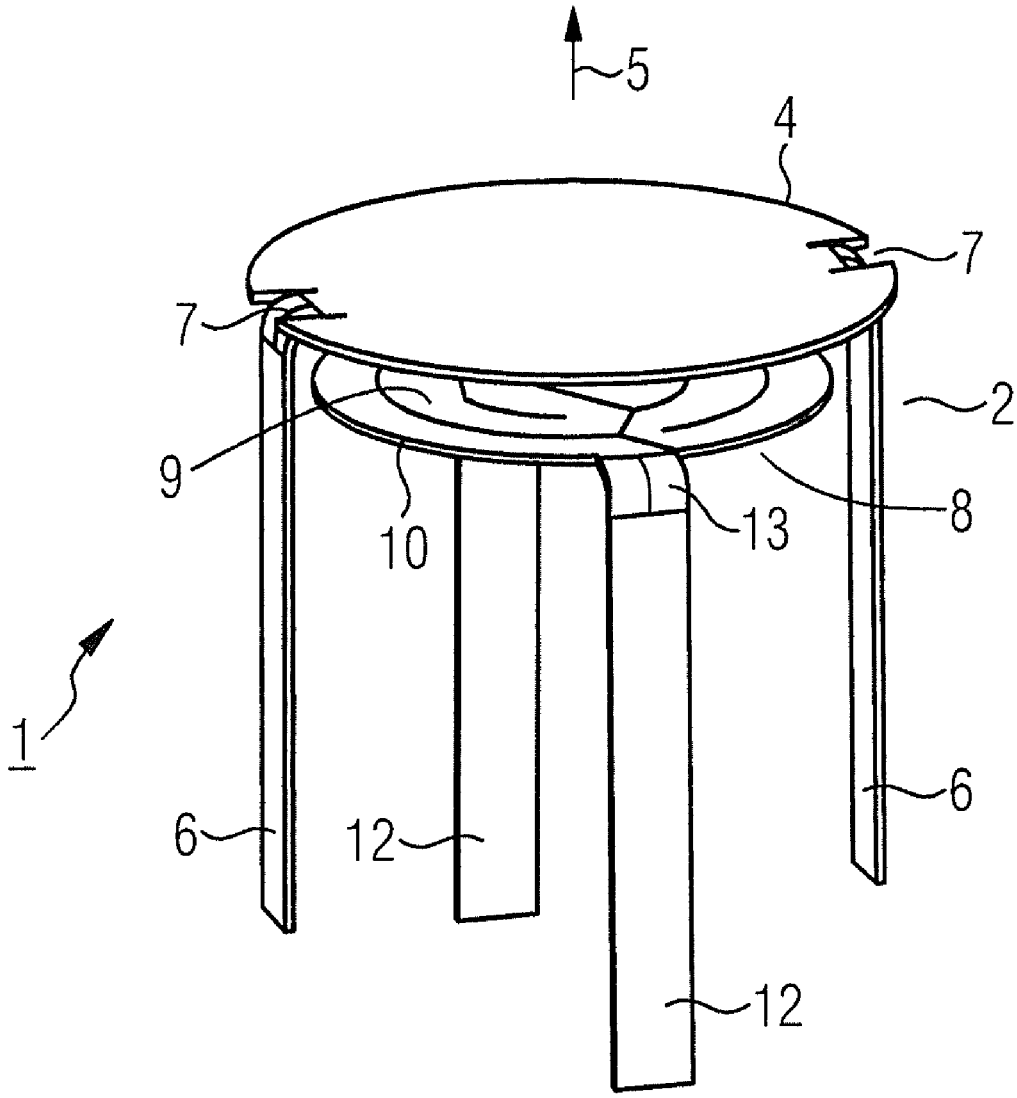
FIG. 1 shows a thermionic emission device with an unstructured primary emitter in a first embodiment and a structured heating emitter, in a perspective view.

The thermionic emission device 1 shown in FIG. 1 has a primary emitter 2 fashioned as a flat emitter, with an unstructured primary emission surface 4 and two terminal lugs 6 that are connected in the connection regions 7 with the outer edge of the primary emission surface 4. For a particularly space-saving mounting in the lateral direction, and to prevent unwanted emissions outside of the primary emission surface 4, the terminal lugs 6 are aligned essentially perpendicular to the primary emission surface 4. An unwanted deflection of the primary emission surface 4 as a result of thermal expansion is thereby also counteracted. The terminal lugs 6 and the primary emission surface 4 thus can be separately manufactured components that are connected with one another or are molded to one another. Primary emission surface 4 and terminal lugs 6 can alternatively also be produced from a contiguous piece of material and, for example, be brought into the desired shape via bending of the terminal lugs 6.

In the use of the emission device 1 as intended in an x-ray tube, the electrons emitted from the primary emission surface 4 are accelerated in the primary emission direction 5 towards an anode (not shown).

The emission device 1 furthermore has a heating emitter 8 fashioned as a flat emitter with a structured heat emitter surface 10 that is designed in a serpentine conductor path 9 via slits and with two terminal lugs 12 that are connected in the connection regions 13 with the heat emission surface 10. The primary emission surface 4 and the heat emission surface 10 are arranged essentially parallel to one another and dimensioned such that the heating emission surface 10 and the terminal lugs 6, 12 do not laterally project beyond the primary emission surface 4.

This means that the terminal lugs 12 are aligned perpendicular to the heat emission surface 10, thus run parallel to the terminal lugs 6 of the primary emitter 2. The terminal lugs 6, 12 all point in the same direction, namely counter to the primary emission direction 5, away from the respective emission surface. The heating emitter 8 is therefore effectively nested in the primary emitter 2. With this arrangement no additional space for the current feed and the mounting is required in the lateral direction, i.e. in a direction parallel to the plane of the primary emission surface 4 (and thus transversal to the primary emission direction 5). Rather, these components lie completely "behind" the primary emission surface 4 in the installation space. In a plan view of the emitting front side of the primary emission surface 5, they are covered by it.

In the operating state, an operating current can be supplied to the primary emitter 2 via the terminal lugs 6; a heating current can be supplied to the heating emitter 8 via the terminal lugs 12.

Figure 2:
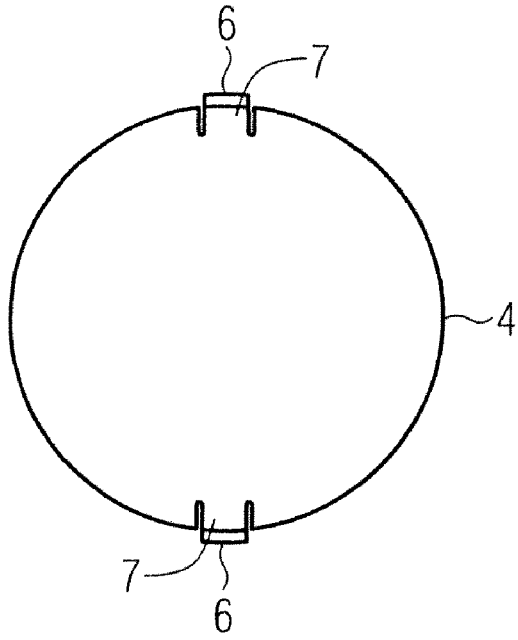
FIG. 2 shows the primary emitter of FIG. 1 according to the first embodiment, in plan view.

A first embodiment of the primary emitter 2 is shown schematically in plan view in FIG. 2. The circular primary emission surface 4 is connected in the connection regions 7 with the terminal lugs 6 (covered in plan view).

Figure 3:
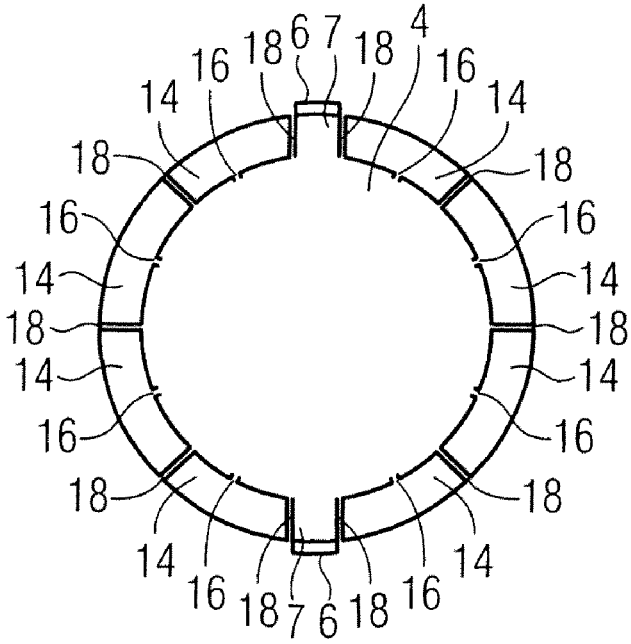
FIG. 3 shows the primary emitter in a second embodiment, in plan view.

A second embodiment of the primary emitter 2 is schematically shown in plan view in FIG. 3. The circular primary emission surface 4 is connected via webs 16 with segments 14 in the shape of circular ring segments 14. The segments 14 have no direct connection with one another and are separated from one another by gaps 18. The webs 16 are of designed such that a current flow from the primary emission surface 4 into the segments 14 is largely prevented so that the segments 14 do not heat and emit electrons. A bending of the electron paths corresponding to the electrons emitted from the outer edge of the primary emission surface 4 is prevented by the segments 14. Furthermore, the presence of the segments 14 reduces the possibility of electrons being emitted from the back side of the primary emission surface 4 facing away from the anode, that would be accelerated toward the anode and thus would enlarge the focal spot.

Figure 4:
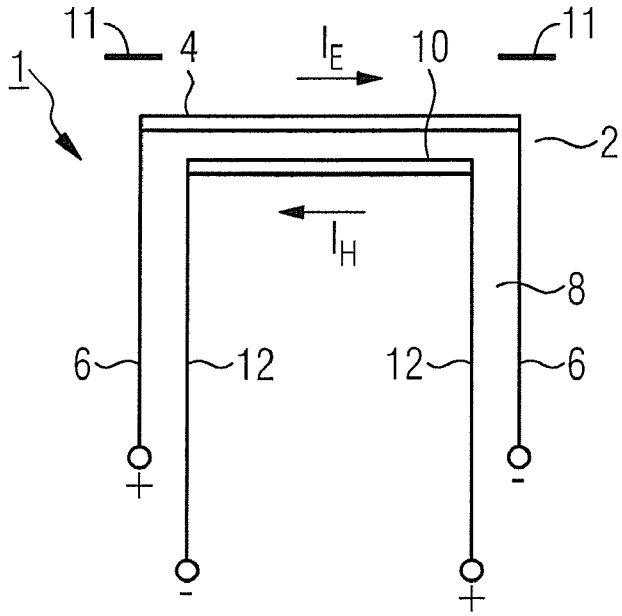
FIG. 4 shows a variant of the thermionic emission device according to FIG. 1 in the operating state, in lateral view.

FIG. 4 shows in a lateral view a preferred variant of the thermionic emission device 1 in the operating state. The two terminal lugs 6 of the primary emitter 2 and the two terminal lugs 12 of the heating emitter 8 are connected with opposite poles of at least current source. An emitter current $I_E$ is directed through the primary emitter 2; a heating current $I_H$ is directed through the heating emitter 8. In this special arrangement, all four terminal lugs 6, 12 are essentially arranged in a row (deviating from the variant according to FIG. 1). This means that all four connection points 7, 13 lie along an imaginary straight line (deviating from the presentation in FIG. 1). The currents $I_E$ and $I_H$ are directed oppositely. The amperages of thee two currents are advantageously set to be essentially equal in magnitude. In this way the magnetic fields generated by the currents $I_E$ and $I_H$ compensate one another for the most part, and their influence on the electron paths of the emitted electrons is largely canceled.

Also shown in FIG. 4 is a diaphragm 11 that surrounds the primary emitter 2 at a side of the primary emitter 2 opposite the heating emitter 8, the diaphragm 11 limiting the region of the primary emission surface 4 from which emitted electrons arrive at the anode.

Figure 5:
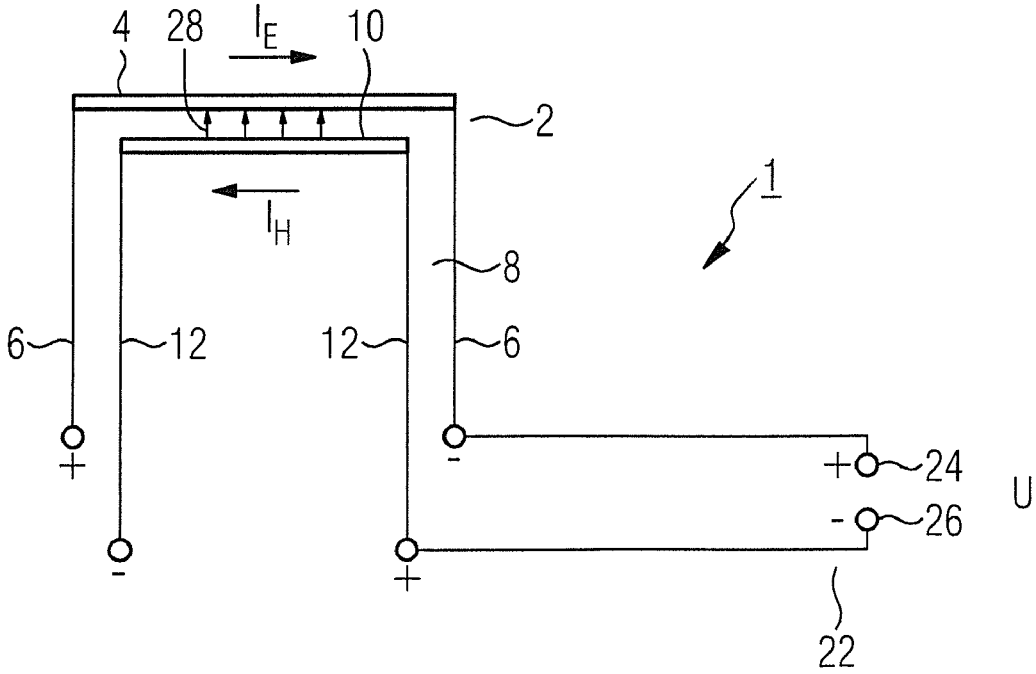
FIG. 5 shows the thermionic emission device according to FIG. 4 in the operating state with a connected voltage source, in a lateral view.

The thermionic emission device 1 in the operating state is shown in a further embodiment in a lateral view in FIG. 5. The positive pole of a voltage source 22 is connected with one of the terminal lugs 6 of the primary emitter 2; its negative pole is connected with one of the terminal lugs 12 of the heating emitter 8. The applied voltage U should advantageously be between 0 and 300 volts. The electrons thermionically escaping from the heating emitter 8 are accelerated in an electrical field with field direction 28 in the direction of the primary emission surface 4. The effect of the indirect heating of the primary emission surface 4 via electron bombardment is thereby optimized.

Although modifications and changes may be suggested by those skilled in the art, it is the intention of the inventor to embody within the patent warranted hereon all changes and modifications as reasonably and properly come within the scope of his contribution to the art.

I claim as my invention:

1. A thermionic emission device comprising:

an indirectly heated primary emitter having a flat, unstructured primary emission surface;

a heating emitter having a flat, structured heat emission surface from which heat is emitted to indirectly heat said primary emitter; and each of said primary emitter and said heating emitter comprising at least two terminal lugs and said primary emission surface of said primary emitter and said heat emission surface of said heating emitter being substantially parallel with each other, with the terminal lugs of the primary emitter being aligned substantially perpendicularly to the primary emission surface of said primary emitter and not laterally protruding beyond said primary emission surface of said primary emitter.

2. A thermionic emission device as claimed in claim 1 wherein said heat emission surface of said heating emitter does not laterally protrude beyond said primary emission surface of said primary emitter.

3. A thermionic emission device as claimed in claim 1 wherein said terminal lugs of said heating emitter do not laterally protrude beyond said primary emission surface of said primary emitter.

4. A thermionic emission device as claimed in claim 1 wherein said heat emission surface of said heating emitter comprises a serpentine conductor path.

5. A thermionic emission device as claimed in claim 1 wherein each of said primary emitter and said heating emitter comprises exactly two terminal lugs that are connected opposite each other at respective outer edges of said primary emission surface of said primary emitter and said emission surface of said heating emitter.

6. A thermionic emission device as claimed in claim 5 wherein said terminal lugs of said primary emitter and said heating emitter are all disposed substantially in a row.

7. A thermionic emission device as claimed in claim 1 wherein each of said primary emission surface of said primary emitter and said heat emission surface of said heating emitter is circular.

8. A thermionic emission device as claimed in claim 7 wherein said primary emitter comprises annular segments located outside of said primary emission surface of said primary emitter, said annular segments being connected with said primary emission surface of said primary emitter by a plurality of webs, with none of said annular segments being in direct connection with each other.

9. A thermionic emission device as claimed in claim 1 comprising a diaphragm surrounding said primary emitter at a side of said primary emitter opposite said heating emitter.

10. A thermionic emission device as claimed in claim 1 comprising a voltage source having a positive pole and a negative pole, said positive pole being connected to said primary emission surface of said primary emitter and said negative pole being connected to said heat emission surface of said heating emitter.

* * * * *